US007690296B2

(12) United States Patent
Seagraves et al.

(10) Patent No.: US 7,690,296 B2
(45) Date of Patent: Apr. 6, 2010

(54) WASTE BALING METHOD AND APPARATUS

(75) Inventors: Steven G. Seagraves, Caledonia, MS (US); Richard D. Pyle, Jasper, AL (US)

(73) Assignee: Marathon Equipment Company, Vernon, AL (US)

( * ) Notice: Subject to any disclaimer, the term of this patent is extended or adjusted under 35 U.S.C. 154(b) by 0 days.

(21) Appl. No.: 12/143,932

(22) Filed: Jun. 23, 2008

(65) Prior Publication Data

US 2008/0307981 A1 Dec. 18, 2008

Related U.S. Application Data

(63) Continuation of application No. 11/253,788, filed on Oct. 20, 2005, now Pat. No. 7,389,724.

(60) Provisional application No. 60/636,613, filed on Dec. 17, 2004, provisional application No. 60/622,055, filed on Oct. 27, 2004.

(51) Int. Cl.
*B65B 13/28* (2006.01)
*B65B 13/18* (2006.01)

(52) U.S. Cl. ..... 100/2; 100/31; 100/11

(58) Field of Classification Search ..... 100/31, 100/32, 33 R, 2, 11; 140/93.2, 93.6, 115, 140/118, 119, 149
See application file for complete search history.

(56) References Cited

U.S. PATENT DOCUMENTS

| | | | | |
|---|---|---|---|---|
| 1,453,820 | A * | 5/1923 | Wright | 100/7 |
| 2,355,644 | A * | 8/1944 | Haase | 100/23 |
| 4,459,904 | A * | 7/1984 | Probst et al. | 100/11 |
| 4,577,554 | A * | 3/1986 | Brouse | 100/26 |
| 5,870,950 | A * | 2/1999 | Wiedel | 100/33 R |
| 6,032,575 | A * | 3/2000 | Johnson | 100/11 |
| 6,199,475 | B1 * | 3/2001 | Schwelling | 100/31 |
| 7,389,724 | B2 * | 6/2008 | Seagraves et al. | 100/31 |

* cited by examiner

*Primary Examiner*—Jimmy T Nguyen
(74) *Attorney, Agent, or Firm*—Berenato & White, LLC

(57) ABSTRACT

A method and associated apparatus designed to effectively twist and cut baling wire during the baling process. The apparatus includes a twister assembly that has a plurality of gear-driven twister heads. During the baling process the twister assembly extends from a slide housing so that the twister heads engage and twist adjacent strands of baling wire. The twister assembly then retracts back into the slide housing so that the twisted portion of the baling wire is cut by a cutting assembly attached to the slide housing.

13 Claims, 23 Drawing Sheets

WASTE BALING METHOD AND APPARATUS

RELATED APPLICATIONS

This application is a continuation of application Ser. No. 11/253,788, filed Oct. 20, 2005, now U.S. Pat. No. 7,389,724, which is based on U.S. Provisional Patent Application Ser. No. 60/636,613, filed Dec. 17, 2004, and also incorporates U.S. Provisional Application Ser. No. 60/622,055, filed Oct. 27, 2004, the disclosures of which are hereby incorporated be reference, and to which priority is claimed.

FIELD OF THE INVENTION

The invention relates to a method and apparatus for tying bands about bales of compacted waste material. Specifically, the invention relates to a method and apparatus for tying strands of baling wire about bales of compacted material after completion of the compacting process.

BACKGROUND OF THE INVENTION

In a typical automated baling process, a series of binding media are disposed about the bale to maintain its integrity. The binding medium, generally comprising cord or wire, encircles and binds a portion of compacted material. The compacted material can then be more efficiently handled and stored.

Early automated baling machines relied on cumbersome drive systems that utilized sprockets, belts and chains as drive mechanisms. Similarly, hooks were commonly used as a means of twisting the baling wire or tying the baling cord. These machines were susceptible to frequent jamming and were temperamental, fragile, and failed arbitrarily. Further, the machines produced bales that were either too loosely compacted and frequently unraveled, or bales that were too tightly bound so that the binding medium broke during routine handling.

Currently available baling machines still rely heavily on designs based on antiquated technology. Although these machines may be adequate for agricultural applications, they are still subject to premature failure and are generally unsuitable for large-scale industrial applications, such as continuous commercial waste baling operations. Further, the currently available machines are generally inefficient in their use of energy and baling wire. In large industrial-scale applications, the efficient use of energy and material is crucial to the profitability of an operation.

The need exists for a reliable waste baling machine capable of continuous operations on an industrial scale. The current invention provides a robust and effective baling machine that efficiently uses the available resources to produce securely bound bales of compacted material.

SUMMARY OF THE INVENTION

The present invention is a baling machine for securing wire ties about a bale of material. The machine comprises a twister assembly that has a plurality of twister heads. The twister assembly is disposed in a slide housing so that the twister assembly slides longitudinally along an axis within the slide housing. A cutting assembly is operatively associated with the slide housing. A drive operatively associated with the slide housing selectively reciprocates the twister assembly relative to the slide housing between an extended position and a retracted position. In the extended position the twister heads engage and twist the wire ties. The twisted wire ties are cut by engagement with the cutting assembly when the twister assembly is moved to the retracted position.

The baling machine of the present invention also comprises a twister assembly having three interlocking gears. The three interlocking gears drive five twister heads positioned vertically along a first edge of the twister assembly. Each of the five twister heads comprises a gear assembly. The twister assembly is disposed within a slide housing so that the twister assembly slides horizontally along an axis extending within the slide housing. A cutting assembly is attached to the slide housing. A piston and cylinder assembly has a first end attached to the slide housing and a second end attached to the twister assembly for selectively reciprocating the twister assembly relative to the slide housing between an extended position and a retracted position. In the extended position the twister heads extend from the slide housing and engage and twist the wire ties, thereby creating a twisted section of baling wire. In the retracted position, the twister assembly is retracted within the slide housing so that the twisted section is cut by the cutting assembly.

The present invention also comprises a method of tying wire ties about a bale of material. The method includes providing a bale of material that is at least partially enclosed by at least one loop of baling wire. The loop is formed by a strand of baling wire having first and second integral lengths. The twister assembly is extended outwardly from within the slide housing so that at least a first twister head of the twister assembly engages the first and second integral lengths of baling wire. The twister head is rotated to twist the baling wire together thereby creating a twisted section of baling wire. The twisted section of baling wire is then cut by retracting the twister assembly and causing the twisted section to engage an operatively associated cutting assembly.

DETAILED DESCRIPTION OF THE INVENTION

Figure 1:
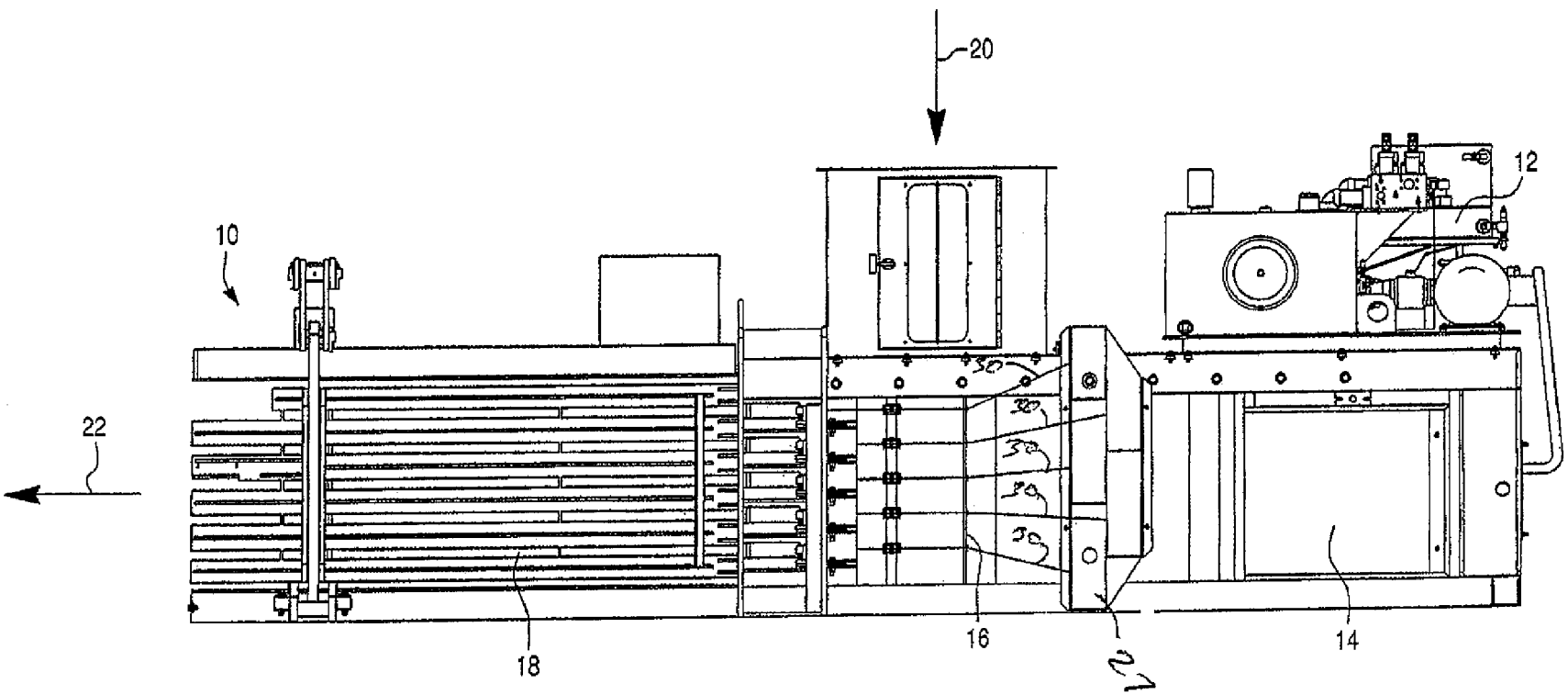
FIG. 1 is a side elevational view of the baling machine of the current invention.
Figure 2:
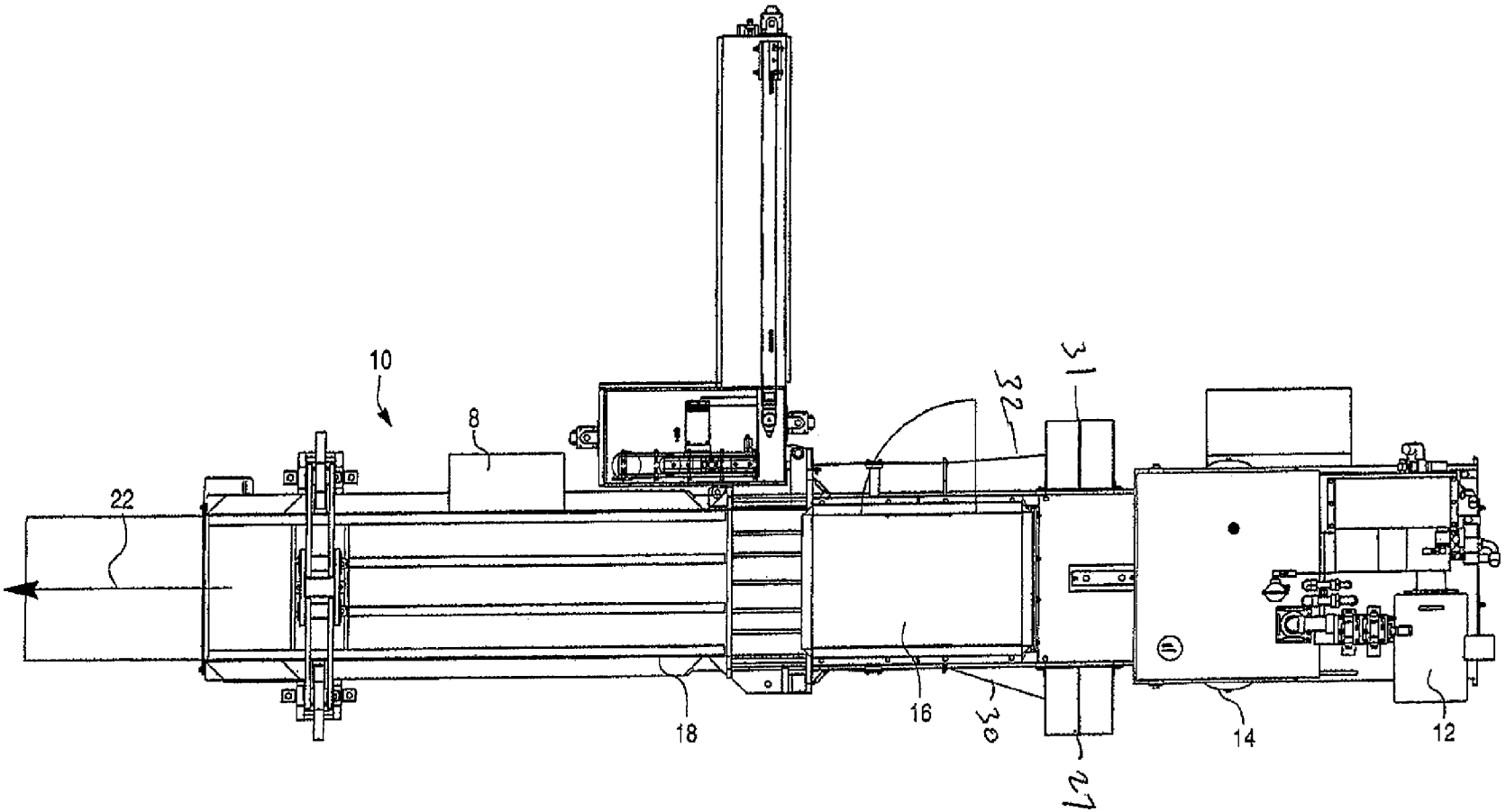
FIG. 2 is a top plan view of the baling machine.

As best shown in FIGS. 1 and 2, the baling machine 10 is comprised of a power unit 12, a hydraulic press section 14, a charge box 16, and a baling chamber 18. As best shown in FIG. 1, first strands of baling wire 30 are arranged in a tiered configuration and extend from a first baling wire dispenser 27 positioned on the opposite side of the charge box 16 and into the baling section 18. As best shown in FIG. 2, on the opposite side of the charge box 16, second strands of baling wire 32 are configured similarly to the first strands 30 and extend from a second baling wire dispenser 31 into the baling section 18 from the opposite side of the baling machine 10. While five strands of baling wire are shown and disclosed, those skilled in the art will recognize that a greater or few number of strands may be used.

As best shown in FIG. 2, a control panel and co-located control unit 8 control the operation of the baling machine 10. The control unit 8 communicates with the baling machine 10 through a programmable control unit, preferably operated with programmable logic controller (PLC) software. The haling machine can also be operated manually through the manipulation of the control panel controls, or in an automated mode that requires no operator input.

In operation, loose, unconsolidated material is fed vertically downwardly into the charge box 16 as best shown by the arrow 20 in FIG. 1. Once the charge box 16 is filled, the power unit 12 supplies power to a hydraulic ram within the hydraulic press section 14. The ram then extends to compact the material within the charge box 16. This filling and compaction process typically will be repeated a number of times, depending upon the material being baled. After a compacted bale has been created, the bale is conveyed horizontally into the baling section 18. During the baling process, the bale is secured by multiple tiers of baling wire. In the preferred embodiment, the bale is secured by five tiers of baling wire 30, 32. After the material has been compacted, baled, and the baling wires 30, 32 tied together and cut, the secured bale is ejected in the direction shown by the arrow 22 in FIGS. 1, 2, and 3A.

Figure 3A:
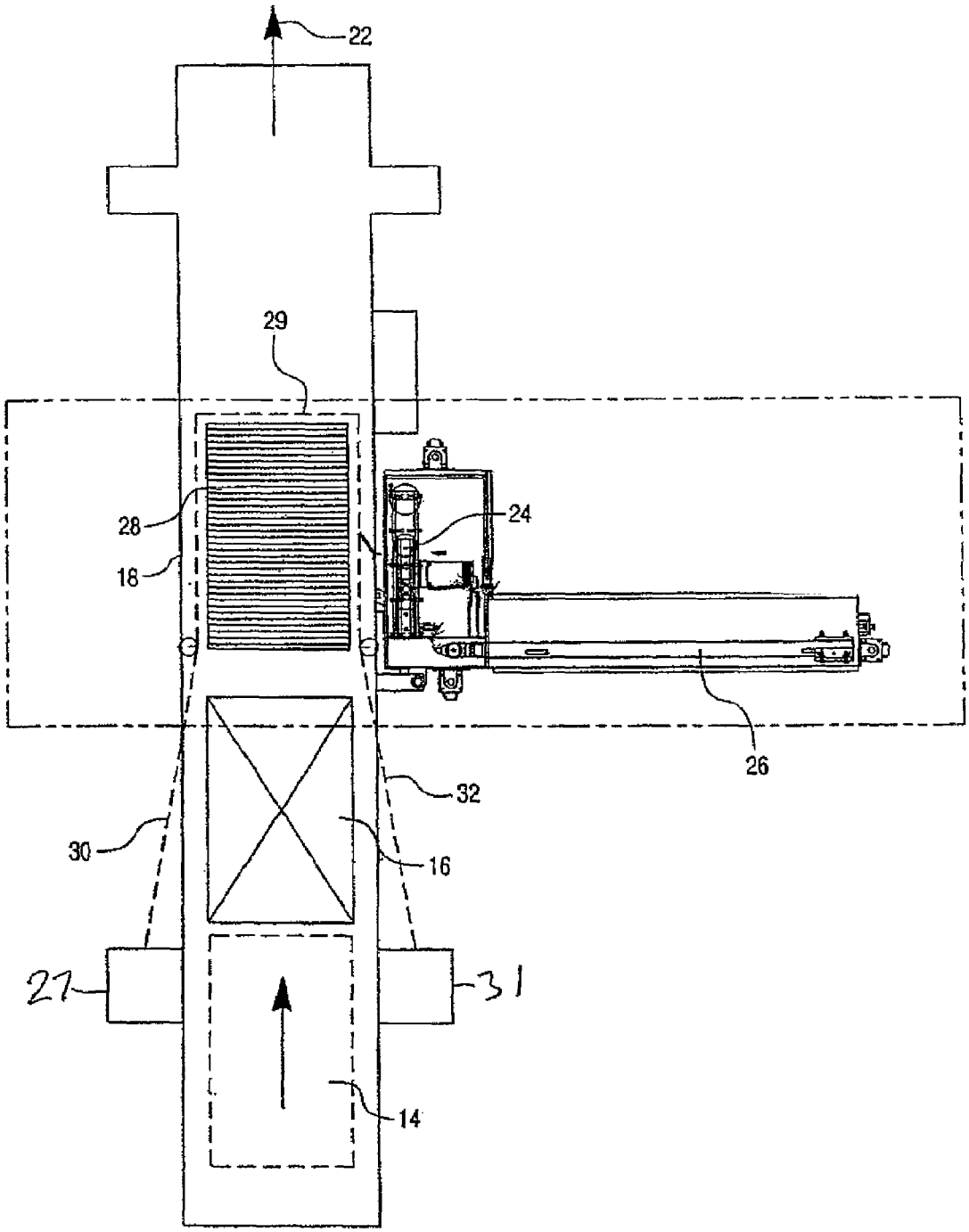
FIGS. 3A-E are fragmentary top plan views that show the baling method of the current invention.

The baling process is illustrated in FIGS. 3A-E. As best shown in FIG. 3A, the baling section 18 includes a binding assembly 24 and a reciprocating baling wire manipulation needle 26. After a bale 28 has been compacted in the charge box 16, the bale 28 is conveyed into the baling section 18. As the bale 28 is conveyed into the baling section 18, the front end of the bale 28 engages a portion of baling wire 29 stretched latterly across the path of the bale 28 in the transition area between the charge box 16 and the baling section 18. The baling wire is comprised of lengths of the first 30 and second 32 strands of baling wire that have been joined at the joint J during the banding of the immediately preceding bale. As the bale 28 proceeds further into the baling section 18, the portion 29 moves with the bale and pulls additional lengths of the wire 30, 32 from the dispensers 27, 31. In this way, movement of the bale 28 causes wire to be pulled from the dispensers 27, 31 so as to extend across the front face of the bale 28 and along its sides beyond the end face.

Figure 3B:
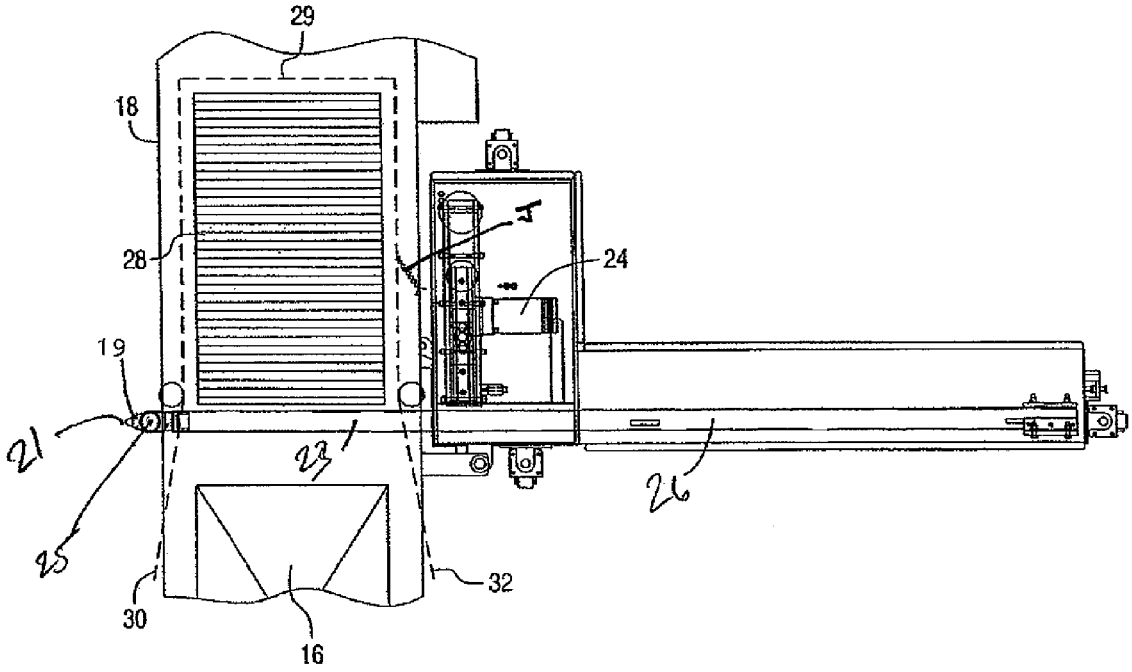
Figure 11B:
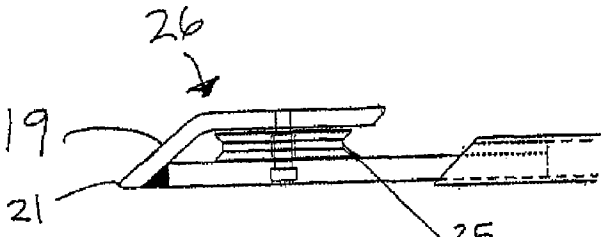
FIG. 11B is a closer view of Detail B of FIG. 11A.
Figure 11A:
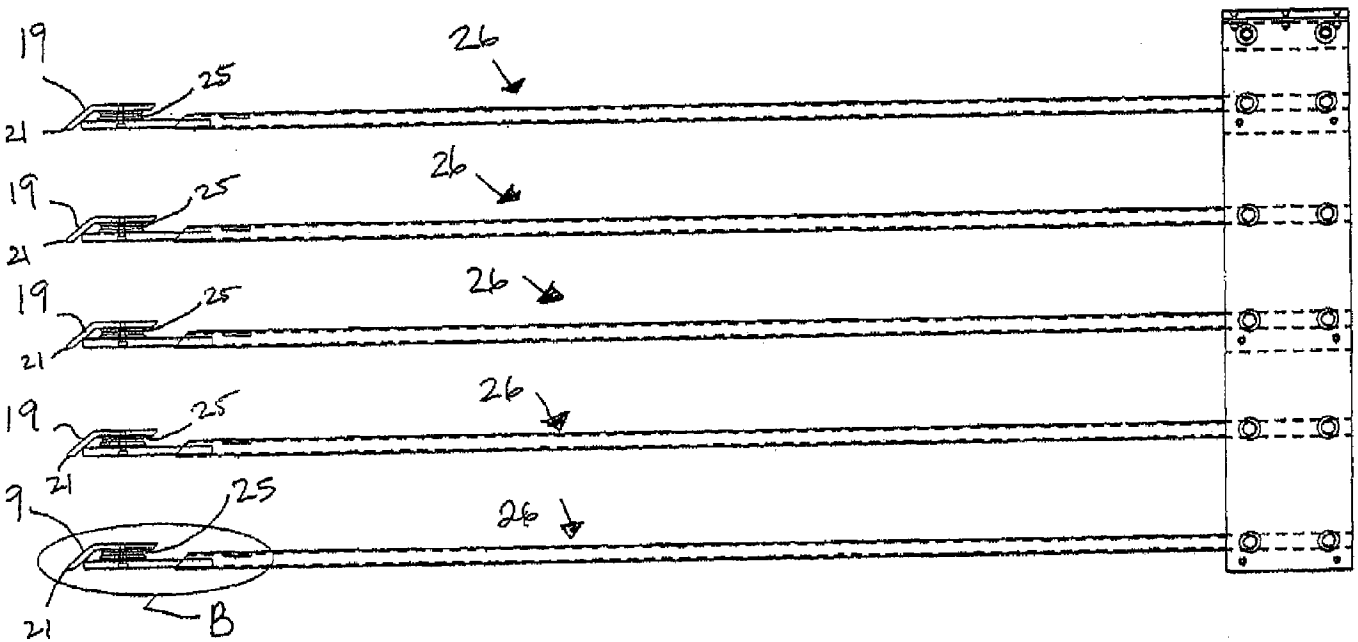
FIG. 11A is a side elevation view of the needle assemblies of the present invention.
Figure 12:
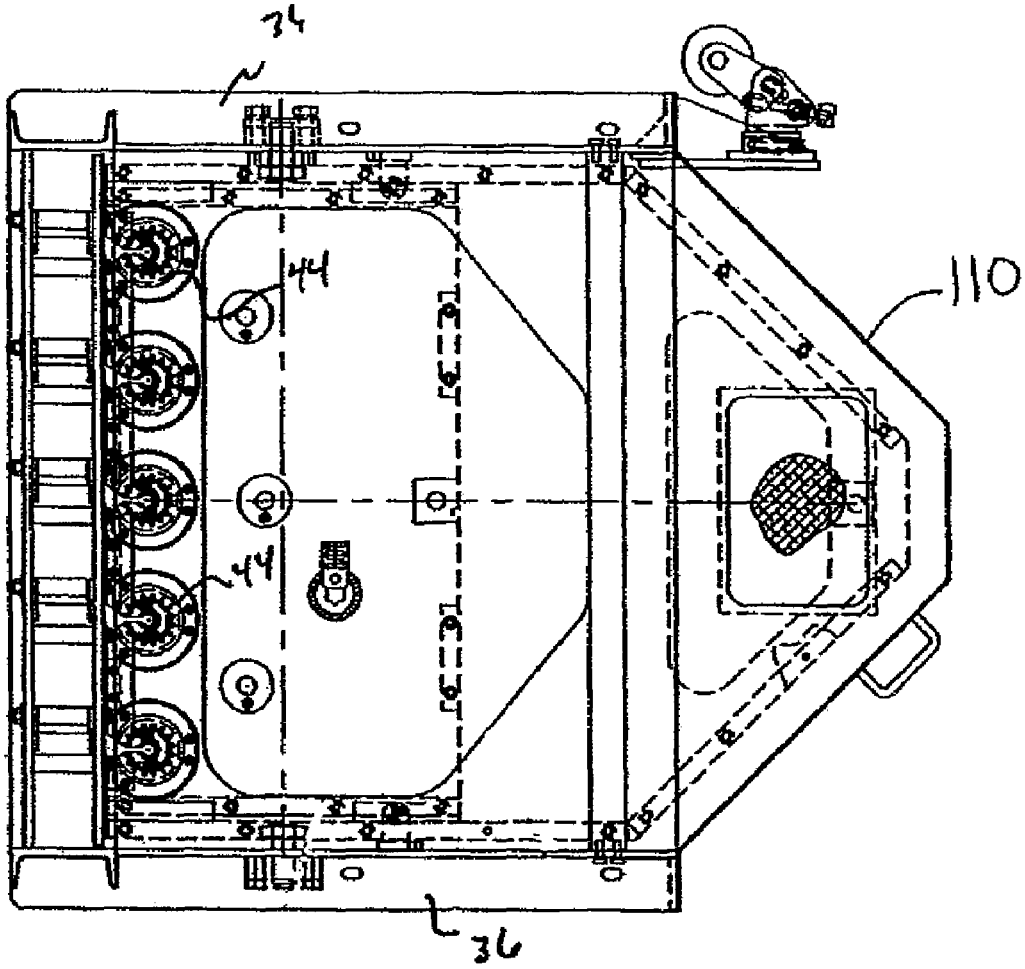
FIG. 12 is an elevational view of an alternative embodiment of the twister assembly of the present invention.

As best shown in FIGS. 3B, 11A and 11B, the head of the needle 26 carries a plate 19. The plate 19 has a tip portion 21 that slants upwardly to a pulley 25 that is positioned adjacent to the plate 19. In the preferred embodiment, there are five needles 26, one for each pair of wires 30 and 32, as shown in FIG. 11B. However, there can be more or less, depending on design preference and application. As the needle 26 extends latterly in response to an operation of a drive from the original position shown in FIG. 3A, the wires 30, 32 slide up and over the plate 19 and grooved pulley 25, so that the wires 30, 32 are not snagged as the needle 26 extends. After the wires 30, 32 slide over the top of the pulley 25, they drop down behind the pulley to the level of the body 23 of the needle 26, as shown in FIGS. 3B and 11B. A pressure switch (not shown) signals the control unit 8 when the needle 26 reaches the fully extended position. After the needle 26 is fully extended, the control unit 8 causes the needle 26 to retract back to its original position.

Figure 3C:
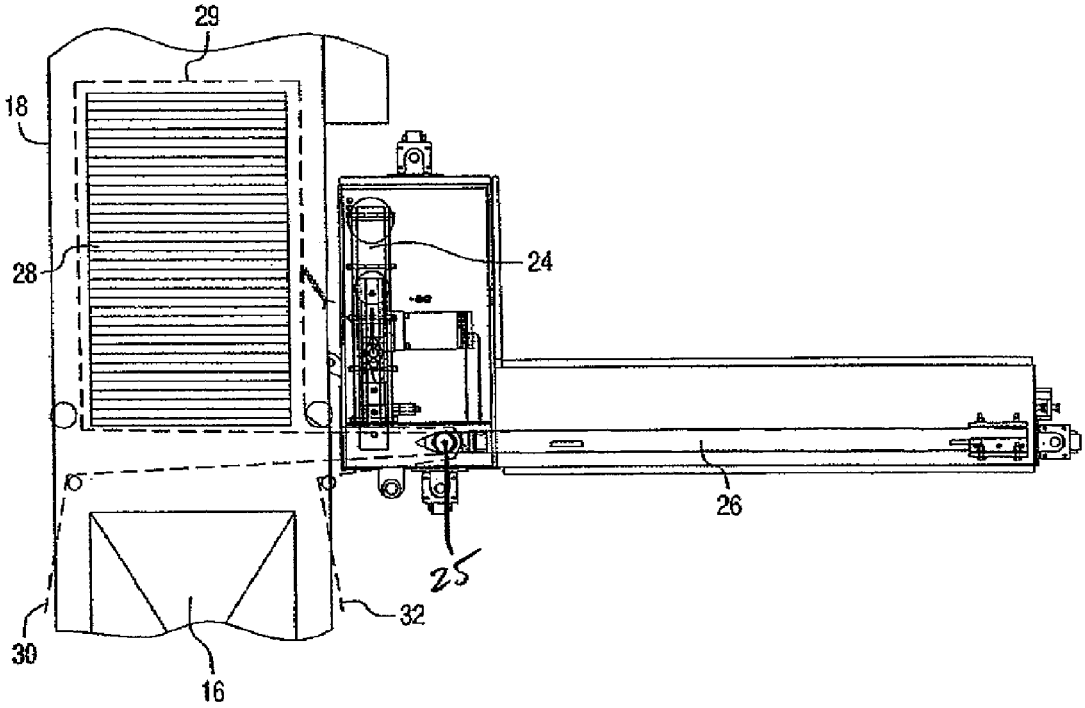

As best shown in FIG. 3C, as the needle 26 retracts, the first strand 30 is engaged by the grooved portion of the pulley 25. As the needle 26 further retracts, it pulls the first strand 30 latterly across the rear portion of the bale 28. The pulley 25 eventually engages the second strand of wire 32, and closes the open end of the loop 29 around the rear portion of the bale 28. After the needle 26 retracts to its original position, the first 30 and second 32 wire strands extend parallel to each other and have positions adjacent to the binding assembly 24. The bale 28 thus has a length of baling wire 30, 32 disposed completely about its periphery with a portion extending toward the needle 26. The binding assembly 24 then engages the first 30 and second 32 baling wire strands.

Figure 3D:
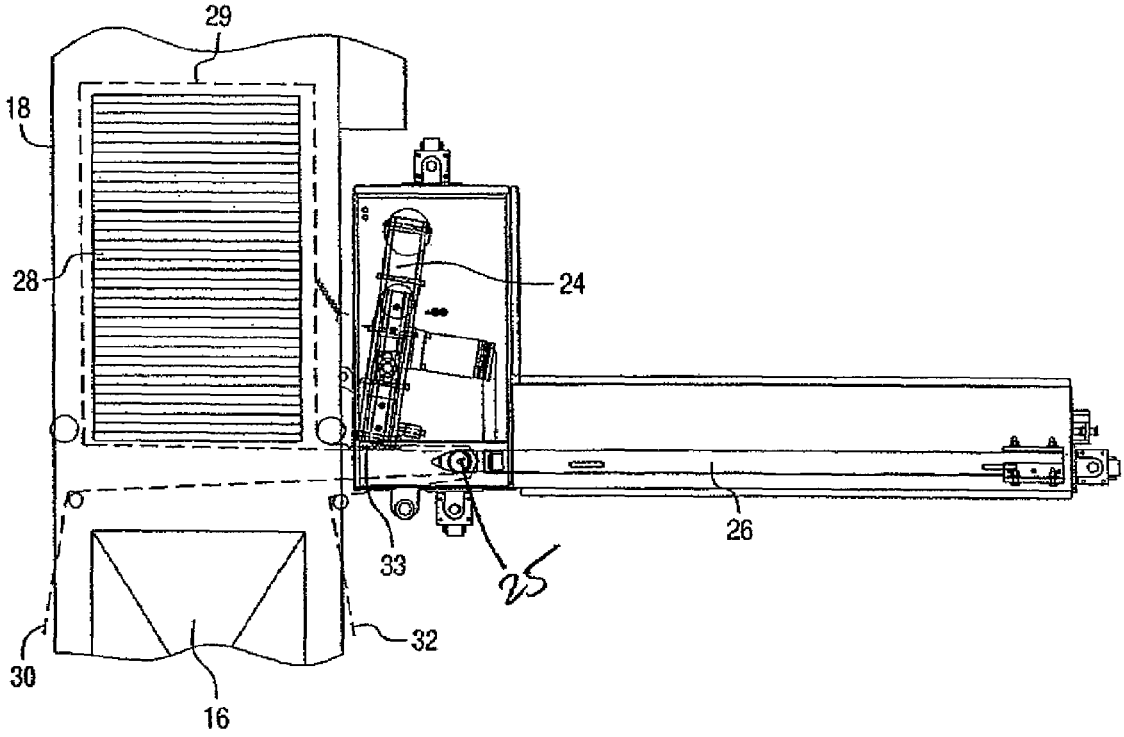

As best shown in FIG. 3D, the first 30 and second 32 strands are then twisted together so that a twisted section of wire 33 is created. As the strands 30, 32 are twisted, the binding assembly 24 pivots and maintains the binding assembly 24 in close proximity to the bale 28. The binding assembly 24 pivots because as the strands 30, 32 are twisted, their length decreases. The binding assembly pivots to accommodate the shortening of the wire length and to prevent the twisted section 33 from breaking or pulling apart.

Figure 3E:
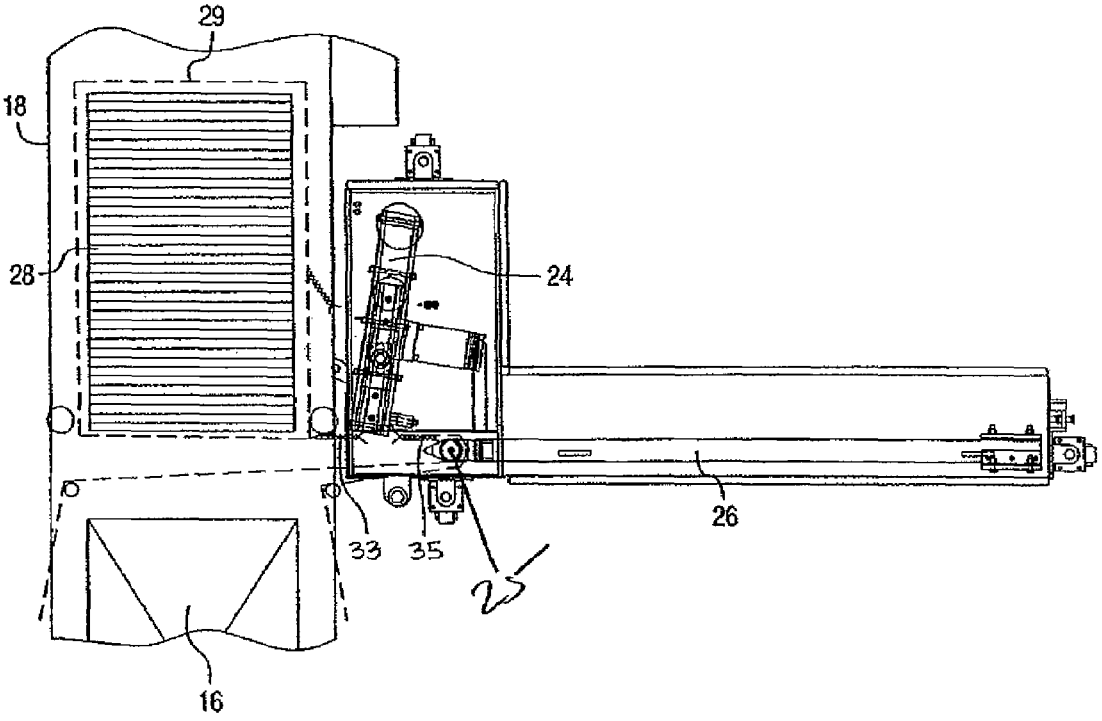

As further shown in FIG. 3E, the twisted section 33 is then cut so that a first portion of the twisted section 34 completes and secures the bale 28. The second portion of the twisted section 35 connects the two strands of baling wire 30, 32 and provides the joint J. The twisted section 35 slides back around the pulley 25 and is stretched latterly across the baling section 18 when it is engage by the next successive bale that is conveyed from the charge box 16.

Figure 4:
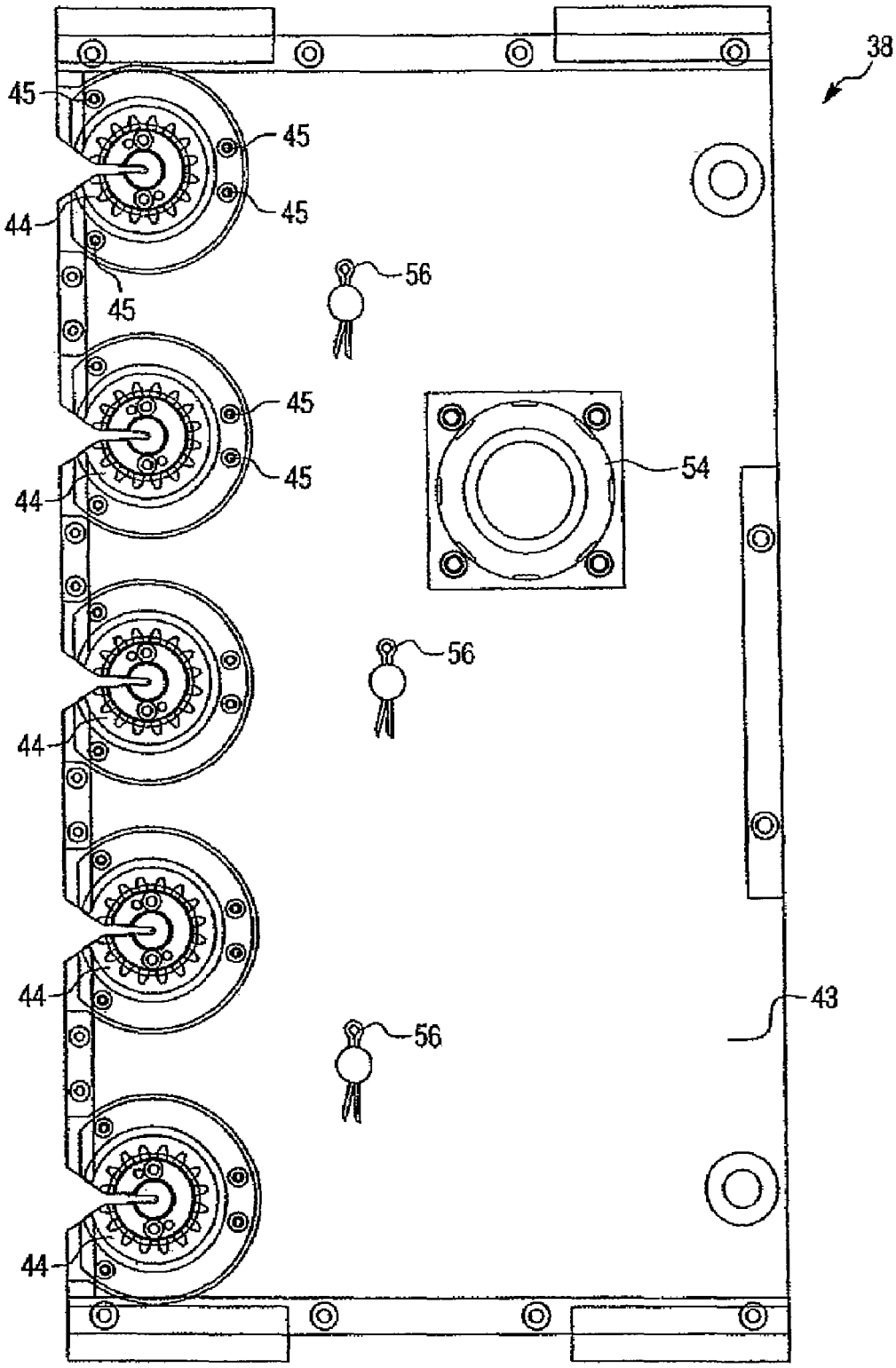
FIG. 4 is a side elevational view of the twister assembly.

The components and function of the binding assembly 24 are shown in more detail in FIGS. 4-9. The binding assembly 24 is comprised of a twister assembly 38 disposed within a slide housing 36. As best shown in FIG. 4, the twister assembly 38 is comprised of five rotary twister heads 44 that are engageable with the strands of baling wire 30, 32 as described above. The twister heads 44 are connected to the side panels 43 of the twister assembly 38 by a plurality of bolts 45. The twister heads 44 twist the wires 30, 32 at approximately 12 revolutions per minute, although higher or lower speeds are within the scope of the invention.

As best shown in FIG. 4, a hydraulic motor 54 extends perpendicularly from the twister assembly side panel 43 and powers the twister assembly 38 and twister heads 44. The hydraulic motor 54 operates at a pressure of 1700-3000 psi. Although a hydraulic motor 54 is depicted, other sources of power should be considered within the scope of the invention.

Figure 5:
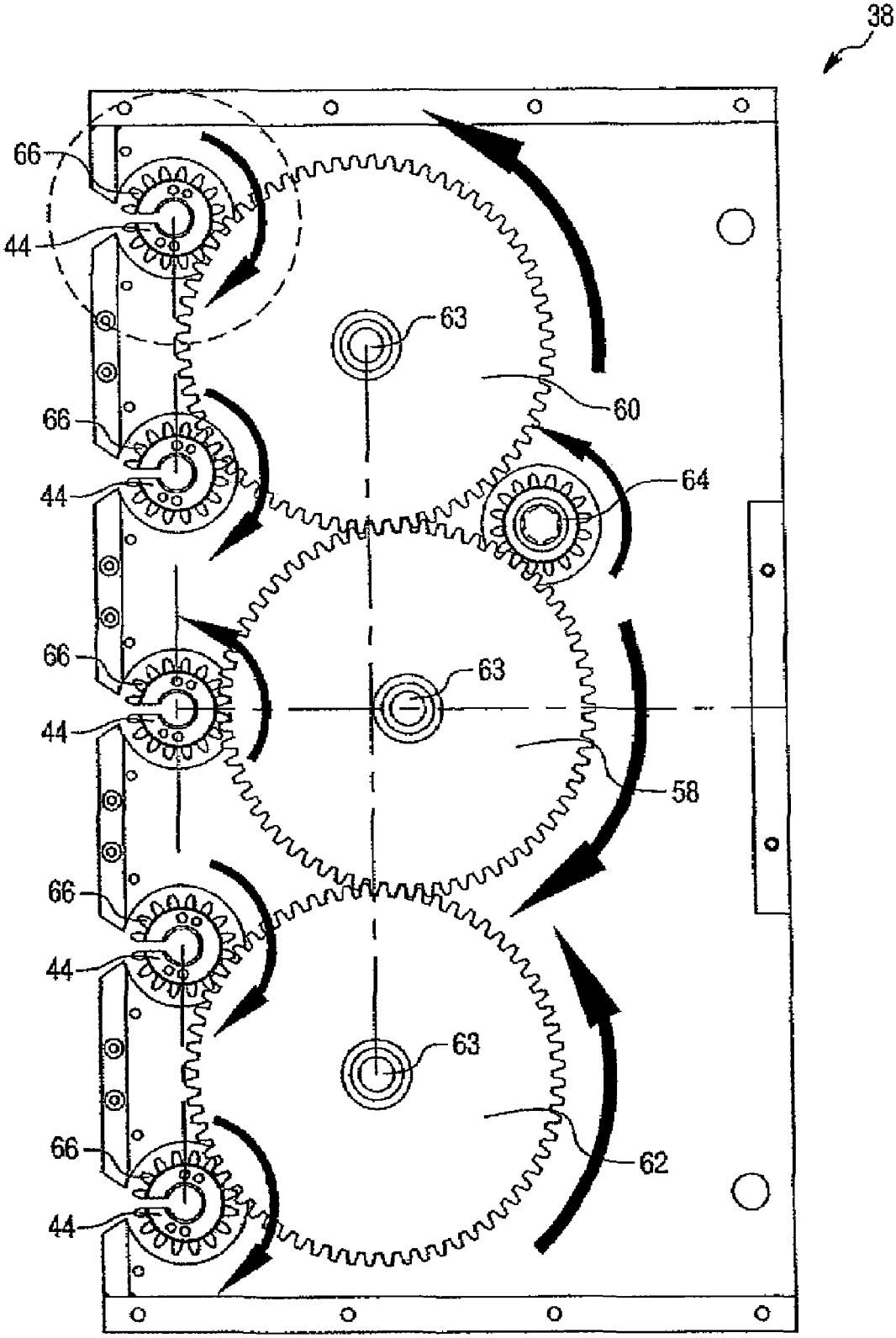
FIG. 5 is a side elevational view of the twister assembly with a side panel of the twister assembly housing removed.

FIG. 5 shows the twister assembly 38 with one of the twister assembly side panels 43 removed. The internal components of the twister assembly 38 are comprised of a primary gear 58 which drives an upper 60 and lower 62 secondary gears. The primary gear 58 is driven by a main drive shaft 64.

The main drive shaft 64 is, in turn, driven by the hydraulic motor 54. The cotter pins 56 best shown in FIG. 4 retain the axels 63 for the primary gear 58 and the upper 60 and lower 62 secondary gears.

As best shown in FIG. 5, the primary gear 58 and the upper 60 and lower 62 secondary gears are meshingly engaged and are disposed in the same plane as the gears 66 of the five twister heads 44. The upper secondary gear 60 drives the gear portions 66 of the two upper twister heads 44, the primary gear 58 drives the gear portion 66 of the center twister head 44, and the lower drive gear 62 drives the gear portions 66 of the two lower twister heads 44. The main drive 64, the upper 60 and lower 62 secondary gears, and the center twister head 44 all rotate in a first direction. The primary gear 58, and the two upper twister heads 44, and the two lower twister heads 44 rotate in a second direction opposite the first direction. The arrows in FIG. 5 illustrate the direction of rotation of the associated gears within the twister housing.

Figure 6:
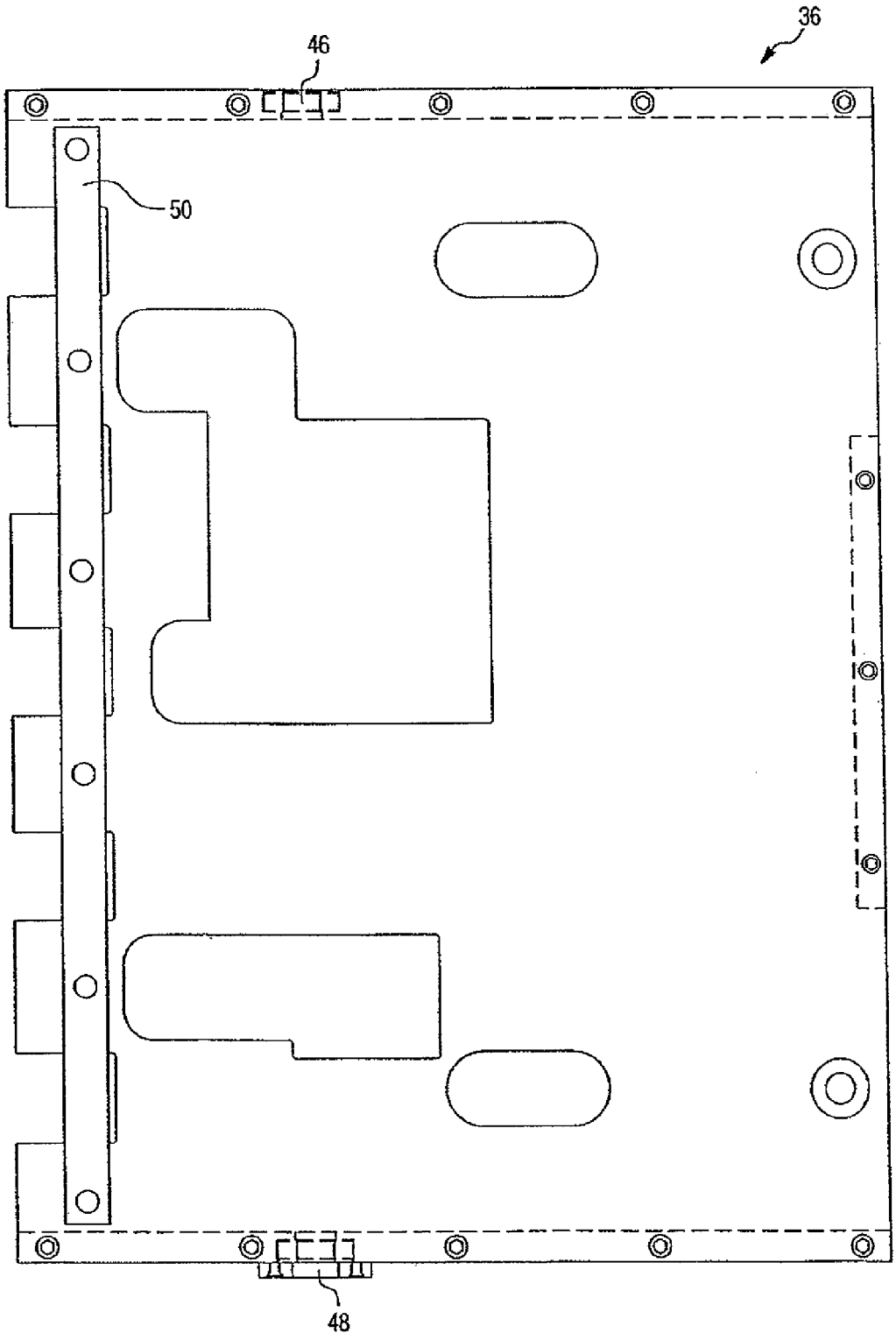
FIG. 6 is a side elevational view of the slide housing.
Figure 8:
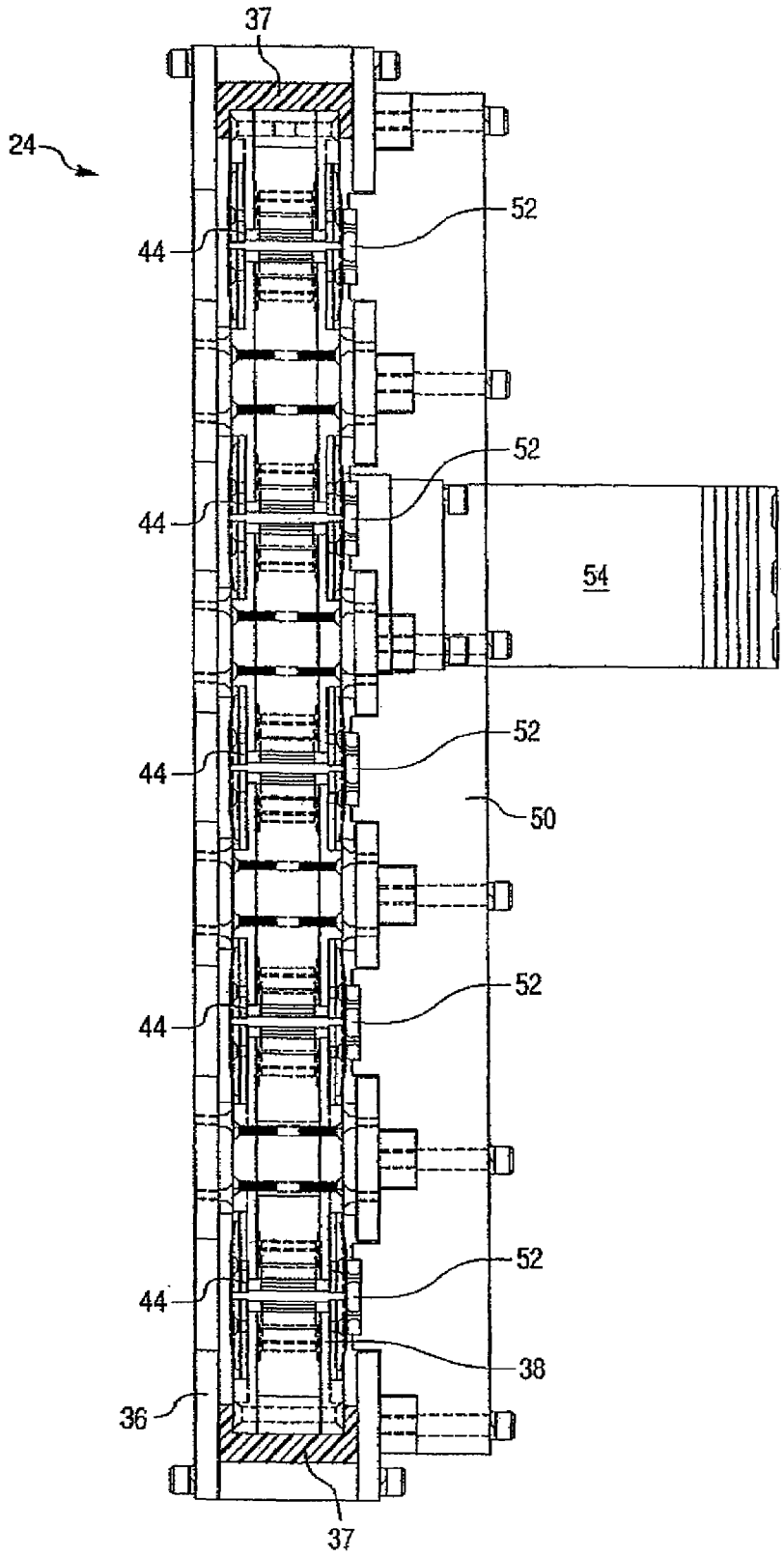
FIG. 8 is an elevational view of the twister assembly disposed within the slide housing with portions of the twister assembly shown in phantom.

As best shown in FIG. 6, the slide housing 36 includes upper 46 and lower 48 pivot bearings and the cutting assembly 50. The pivot bearings 46, 48 allow the slide casing 36 to pivot as the twister assembly 38 twists the baling wire strands 30, 32, as shown and described above. After the baling wires 30, 32 have been twisted, the cutting assembly 50 cuts the twisted section 33 of baling wire (see FIG. 3E). The cutting assembly 50 includes a cutting tooth 52 (as best shown in FIG. 8) corresponding with each twister head 44. Those skilled in the art will recognize that twister assembly 38 has a side panel 43 on its opposite side. The cutting assembly 50 is secured to only one of the side panels 43, however.

Figure 7:
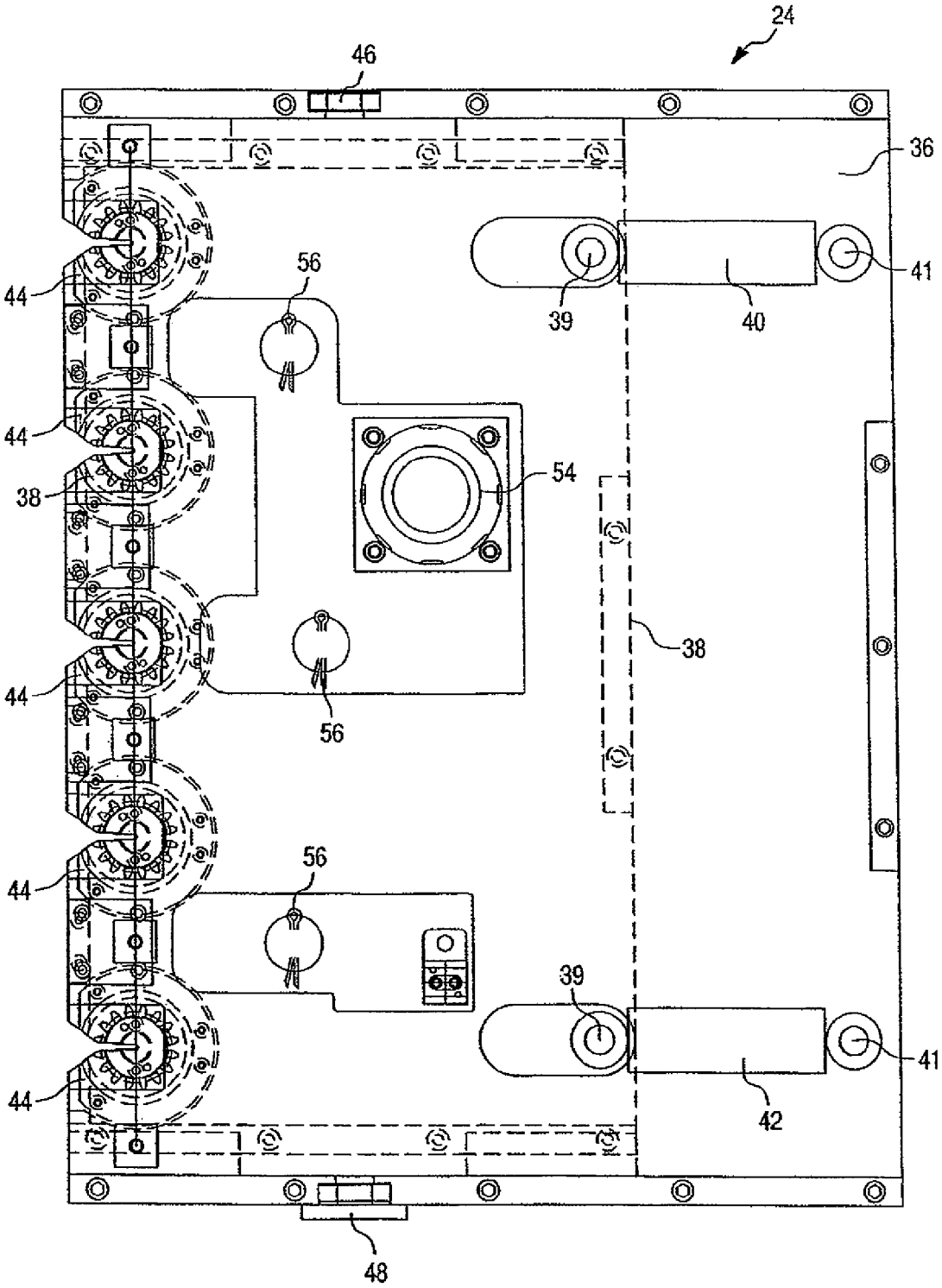
FIG. 7 is a side elevational view of the twister assembly disposed within the slide housing with portions of the twister assembly shown in phantom.

FIGS. 7 and 8 show the twister assembly 38 disposed within the slide housing 36. As best shown in FIG. 7, first 40 and second 42 drive mechanisms have a first end 39 connected to the twister assembly 38 and a second end 41 connected to the slide housing 36. During the baling process, the drive mechanisms 40, 42 reciprocate (extend and retract) the twister assembly 38 horizontally on tracks 37 positioned above and below the twister assembly 38 within the slide housing 36. In the preferred embodiment, the drive mechanisms 40, 42 are comprised of piston and cylinder assemblies, and the tracks 37 are comprised of a plastic material in order to minimize friction and reduce any tendency for seizure with the slide housings 36.

Figure 9A:
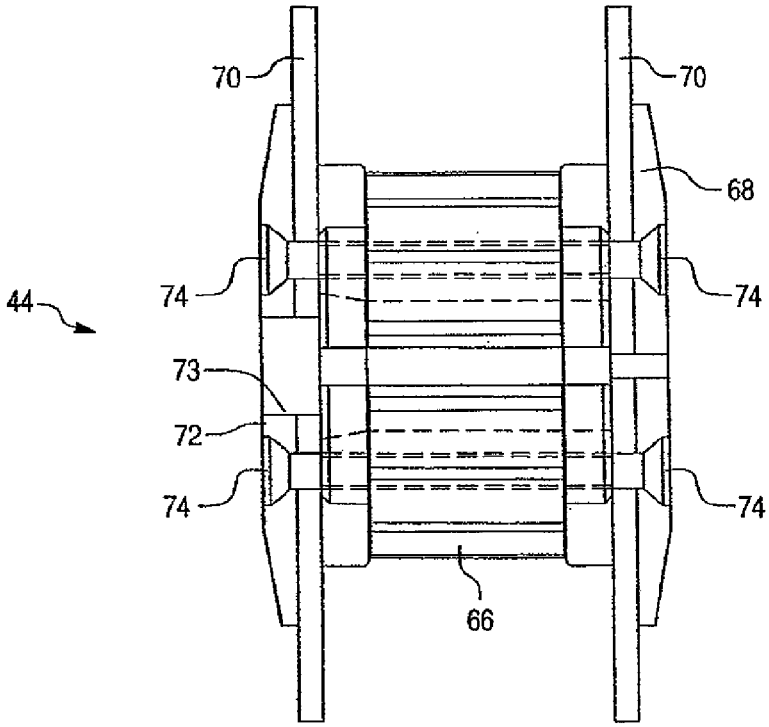
FIG. 9A is an elevational view of a twister head.
Figure 9B:
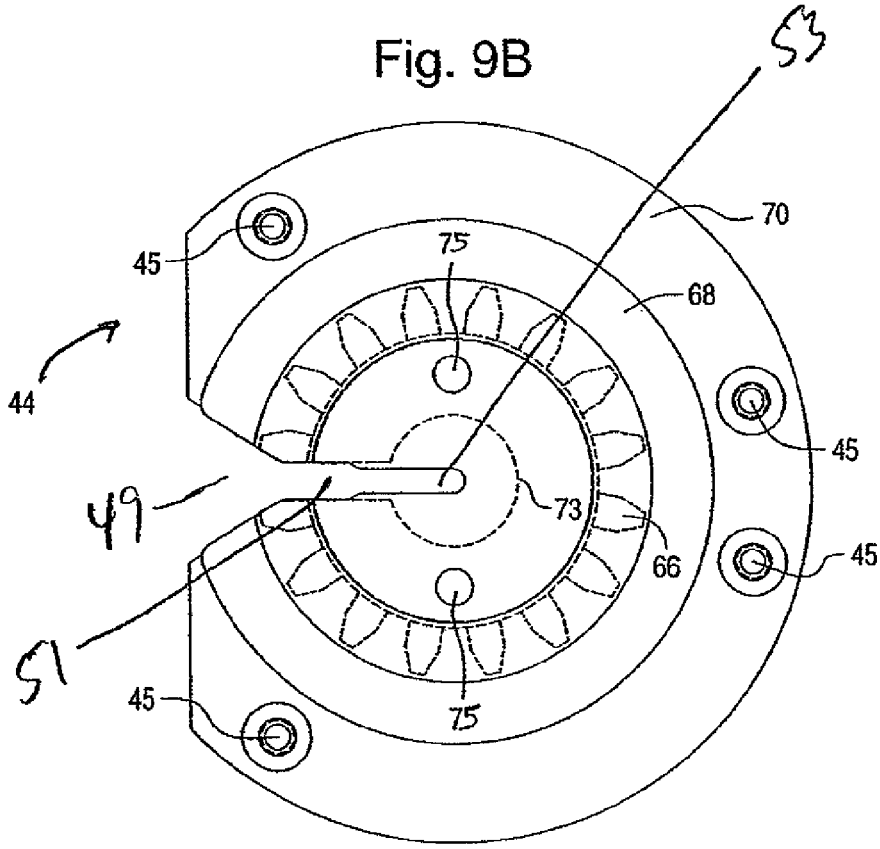
FIG. 9B is a top plan view of a twister bead.
Figure 9C:
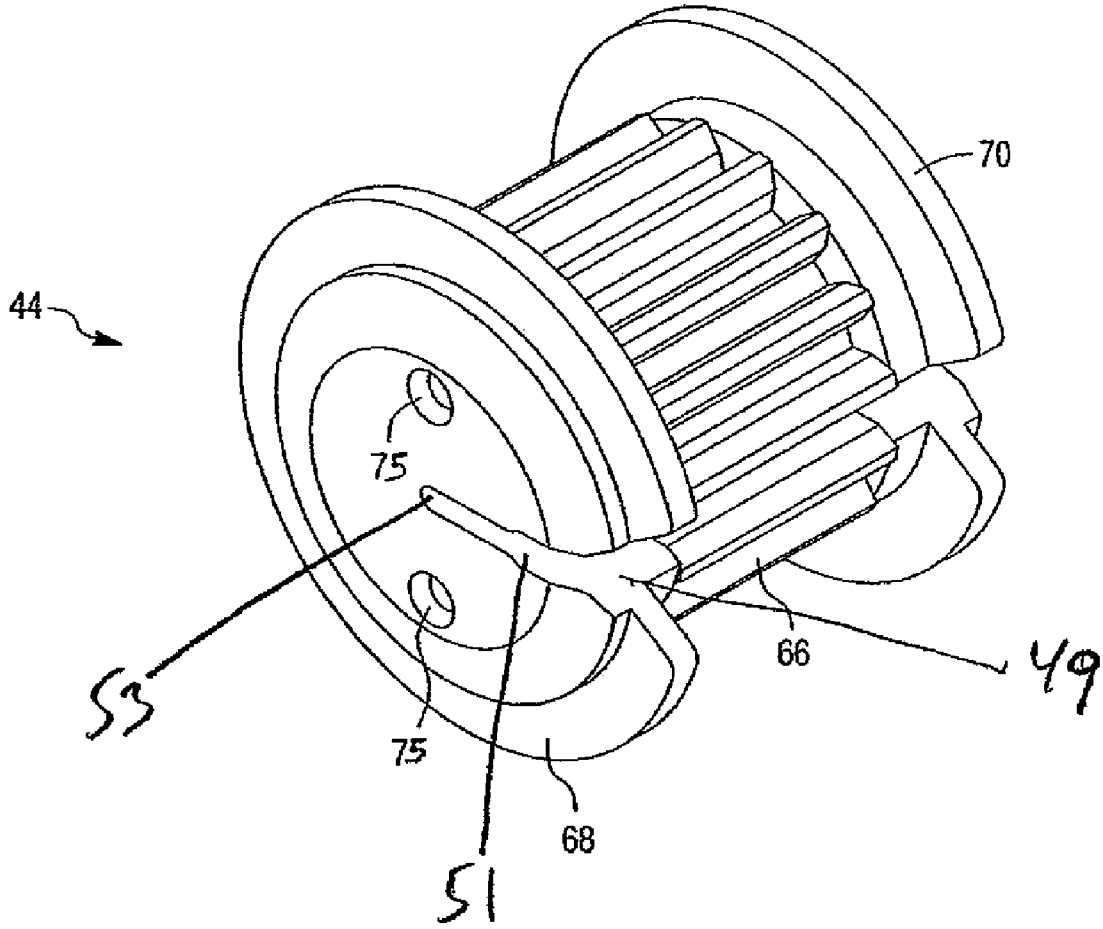
FIG. 9C is a perspective view of a twister head.

Each twister head 44 is comprised of a center gear portion 66, with a rotary head 68, and a bushing 70, attached at one end of the gear portion 66, and a keeper head 72 and a bushing 70 attached at the opposite end, as best shown in FIGS. 9A-9C. In the preferred embodiment, the gear portion 66 is attached to the keeper head 72 and rotary head 68 by a plurality of bolts 74 disposed at the openings 75; however, any connecting means known in the art may be used.

As best shown in FIGS. 9A-9C, the rotary head 68 has a funnel-shaped opening 49 so that when the rotary head 68 is engaging the baling wires 30, 32, the funnel shape of the rotary head 68 guides the baling wire 30, 32 to an intermediate slot 51. The funnel-shaped opening is sufficiently large to accept wires that are not necessarily at the same elevation relative to the twister assembly. The intermediate slot 51 is narrower than the width of the funnel-shaped opening 49, and approximately twice the diameter of the baling wire 30, 32. The intermediate slot 51 guides the baling wires 30, 32 into twisting slot 53 at the center of the rotary head 68 that is only wide enough to accommodate single strands of baling wire in a side by side relationship. When power is applied to the rotary heads 68, the rotary heads 68 rotate the strands of baling wire 30, 32 held in each twisting slot 53 and thereby create the twisted sections 33. The center portion 73 of the keeper head 72 has a circular shape (as best shown in FIG. 9A and by the dashed lines in FIG. 9B) so that the keeper head 72 does not directly twist the baling wire 30, 32. The rotary head 68 is the primary twisting component for creating each helical twisted section 33.

As best shown in FIG. 9A, the rotary head 68 and keeper head 72 ride on the surface of the bushings 70. A planar portion of the rotary head 68 and a planar portion of the keeper head 72 each abut the planar surface of a corresponding bushing 70. As best shown in FIGS. 7 and 9B, the bushings 70 are bolted to the twister assembly side panels 43 by a plurality of bolts 45, although any means of connection known in the art may be used.

Figure 10A:
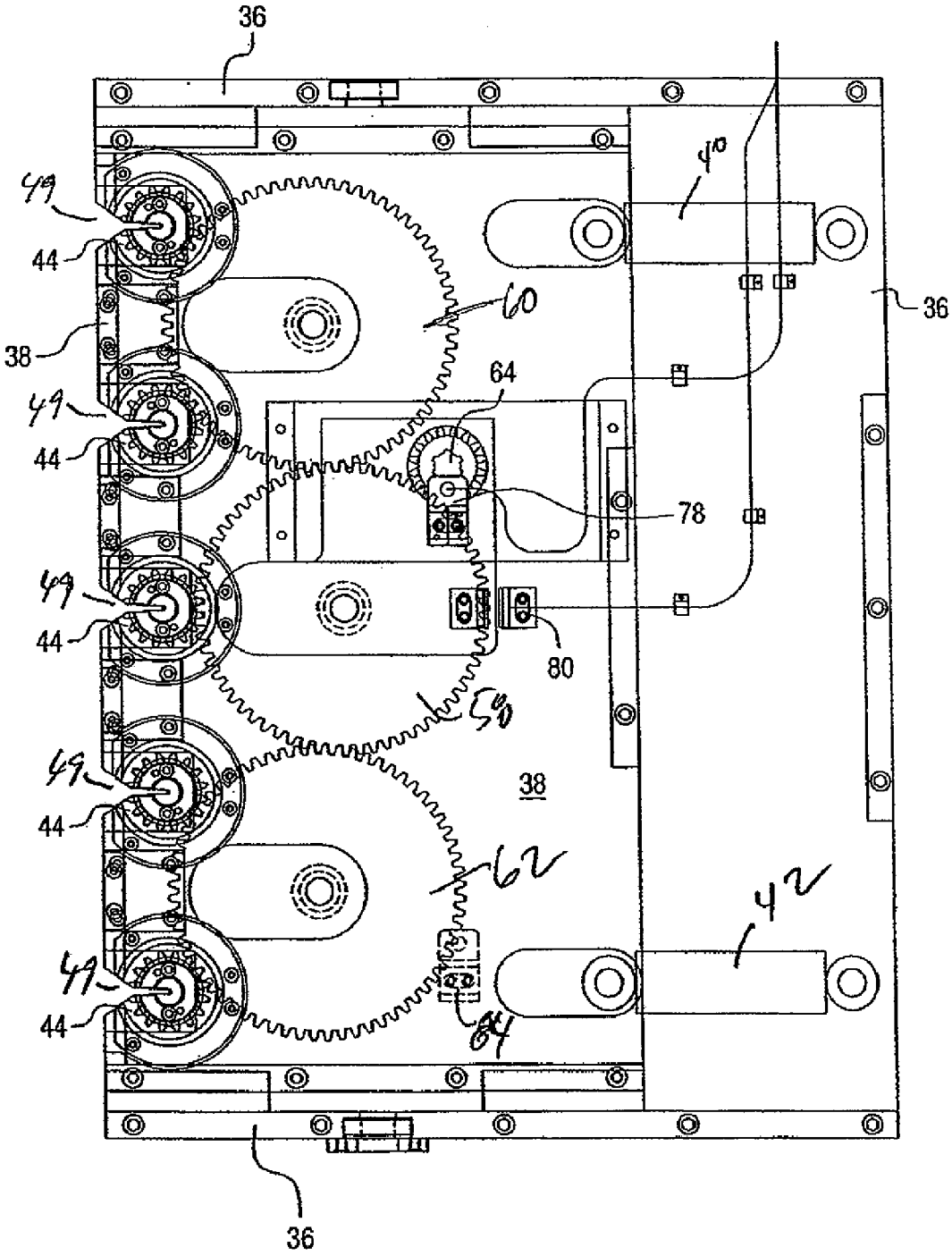
FIGS. 10A-F are side elevational views of the twister assembly disposed within the slide housing as the baling wire is twisted and cut.

As best shown in FIG. 10A, the twister assembly 38 is in the "home" position prior to initiation of the tying process. In the home position, the twister assembly 38 is retracted within the slide housing 36 and the funnel-shaped openings 49 of the twister heads 44 are facing outwardly. A first proximity switch 78 reads a target on the main drive 64 that communicates the position of the twister beads to the control unit 8. A second proximity switch 80 signals the control unit 8 that the twister assembly 38 is in the home position.

Figure 10B:
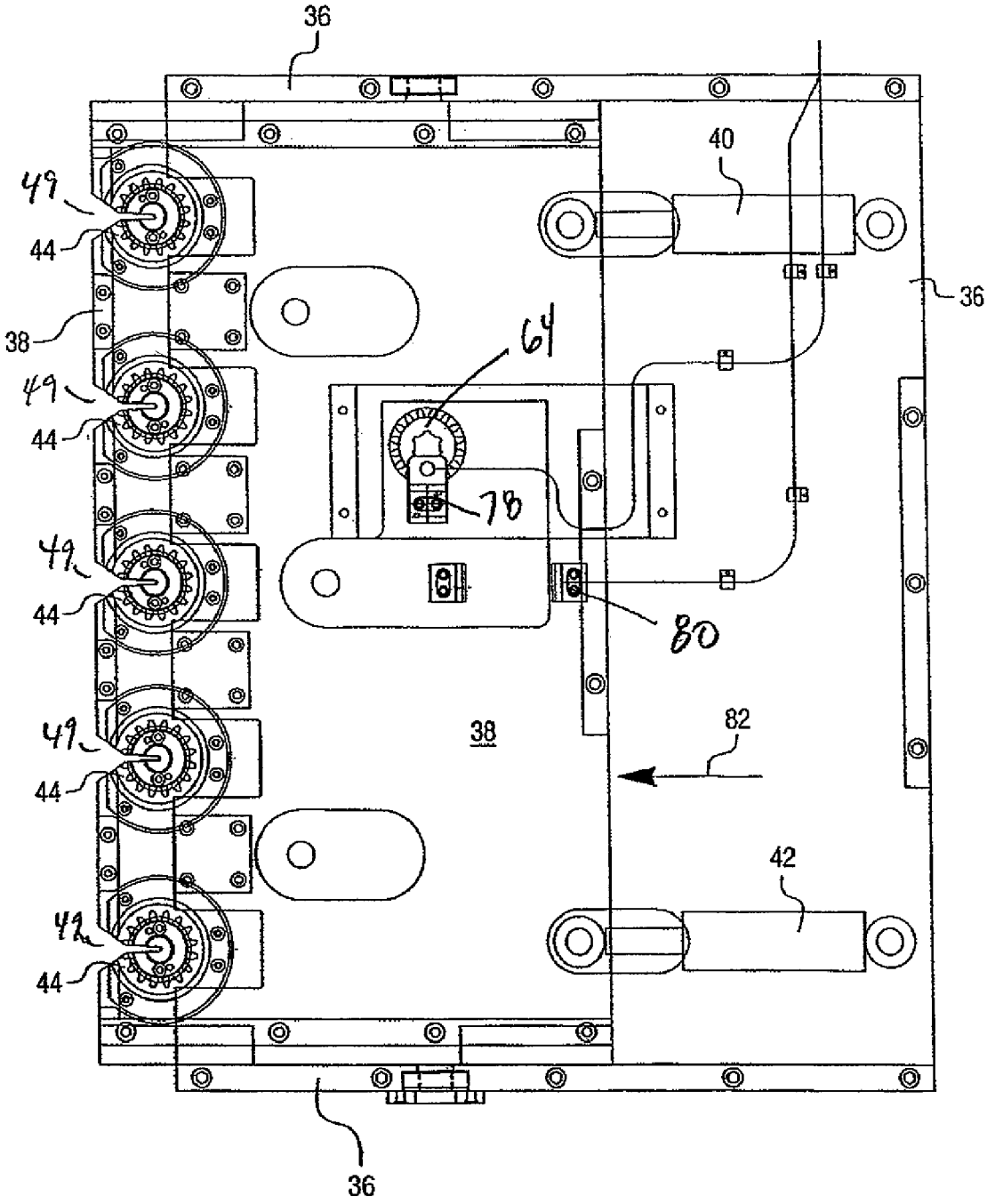

FIG. 10B shows the twister assembly 38 in the extended position. When the first 30 and second 32 strands of baling wire are pulled adjacent to the binding assembly 24 (See FIG. 3C), the drives 40, 42, extend the twister assembly 38 approximately 3" outwardly from the slide housing 36 into the extended position, in the direction indicated by the arrow 82. In the extended position, the wire strands 30, 32 are received within the twister heads 44 and their slots 53.

Figure 10C:
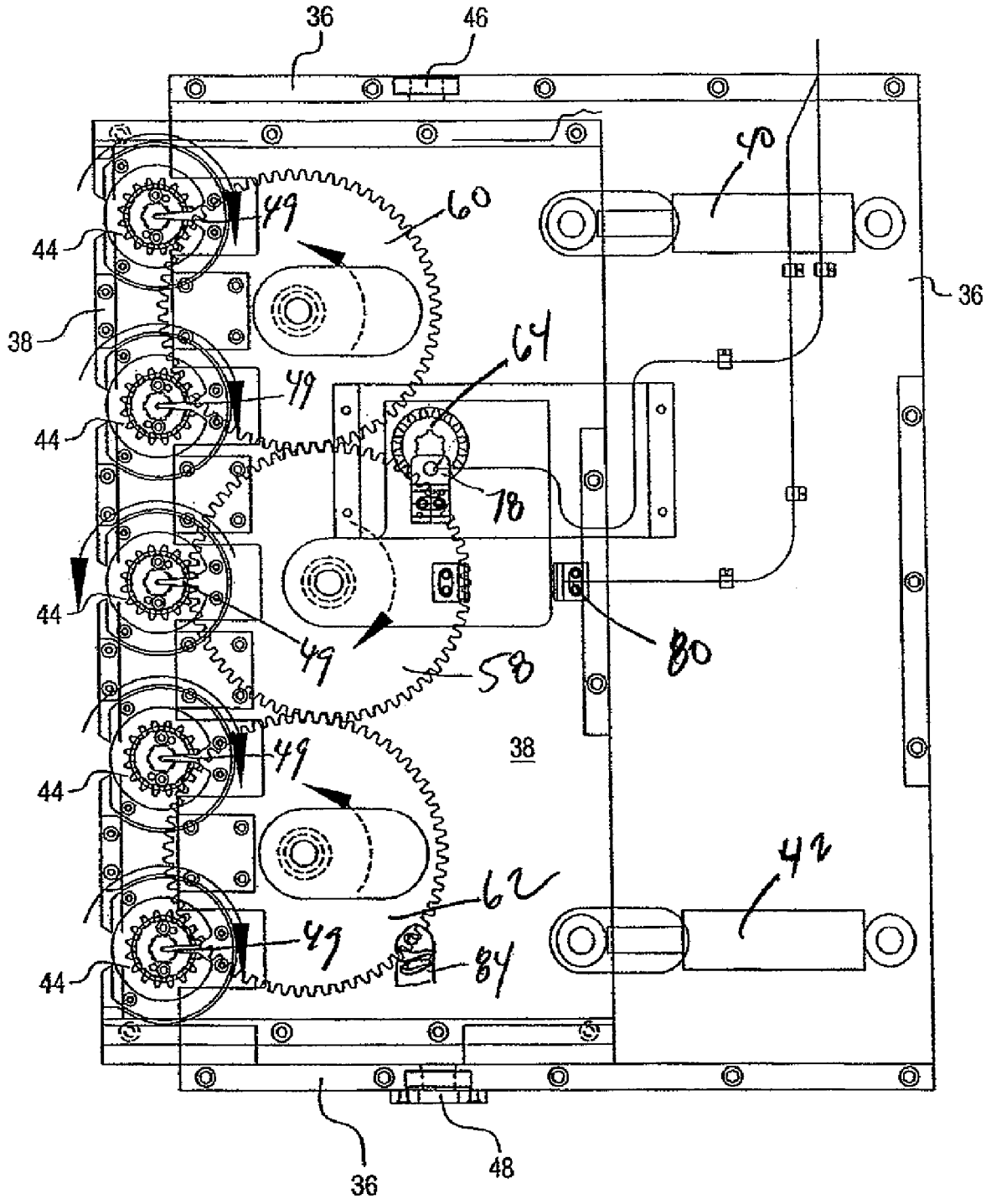

FIG. 10C shows the twister assembly 38 in the twisting position. After the wire strands 30, 32 are received within the slots 53, the wires 30, 32 are twisted by the rotation of the twister heads 44 to form twisted sections 33 (See FIG. 3D). The arrows shown in FIG. 10C illustrate the direction of rotation of the twister assembly 38 internal components. As the wires 30, 32 are twisted, the slide housing 36 pivots on the bearings 46, 48 in order to accommodate the reduction in length of the baling wires 30,32.

Figure 10D:
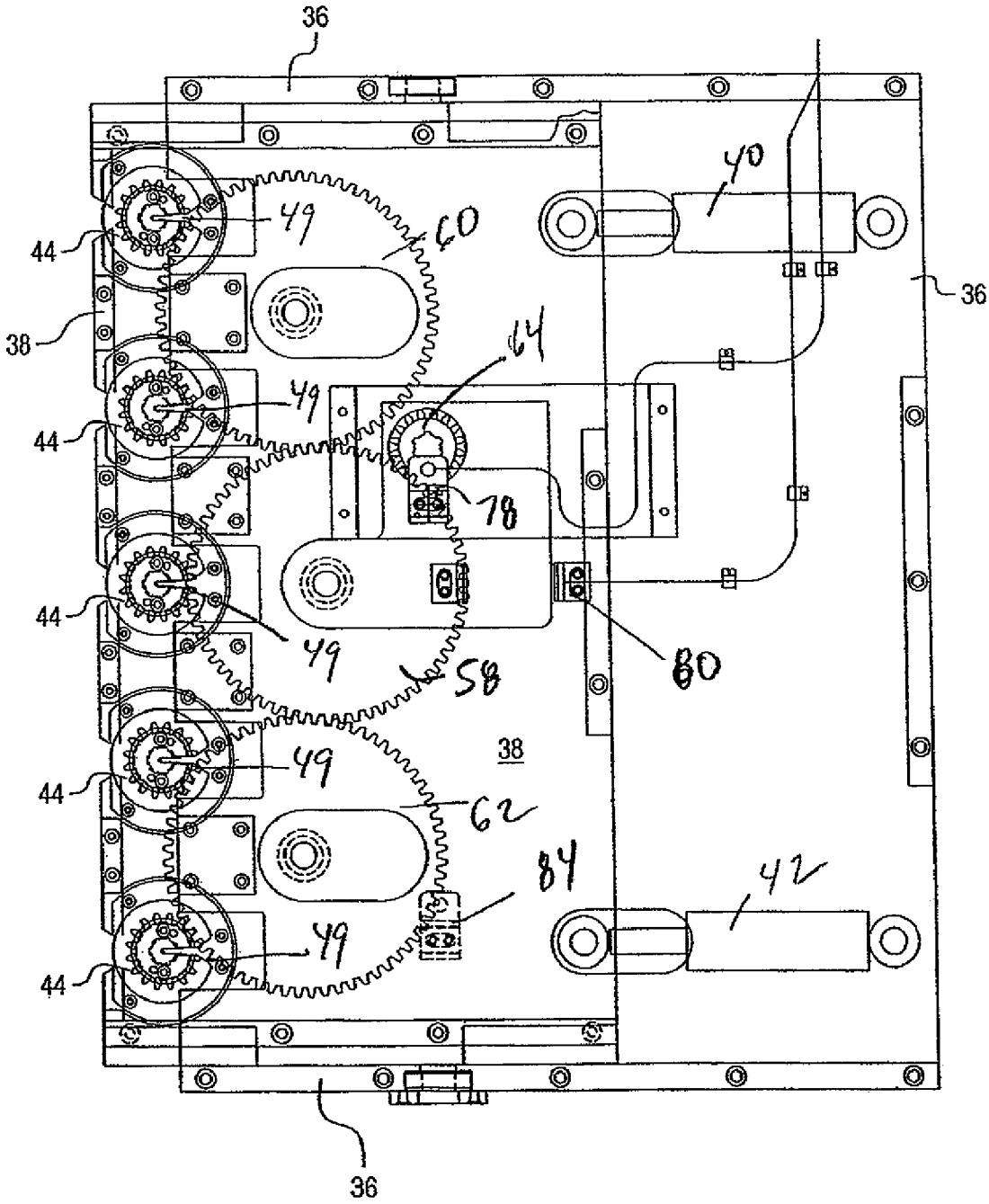

FIG. 10D shows the twister assembly 38 in the locked position after the wires 30, 32 have been twisted together. After the twister assembly 38 has engaged and twisted the wires 30, 32, the twister heads 44 lock with the funnel-shaped openings 49 facing inwardly so that the wire strands 30; 32 are firmly held by the twister assembly 38. A third proximity switch 84 counts the number of teeth on the lower secondary gear 62 during its rotation to determine when the funnel-shaped portions 49 of the twister heads 44 are facing inwardly and the twister assembly 38 is in the locked position. The third proximity switch 84 then communicates the position of the twister heads 44 to the control unit 8.

Figure 10E:
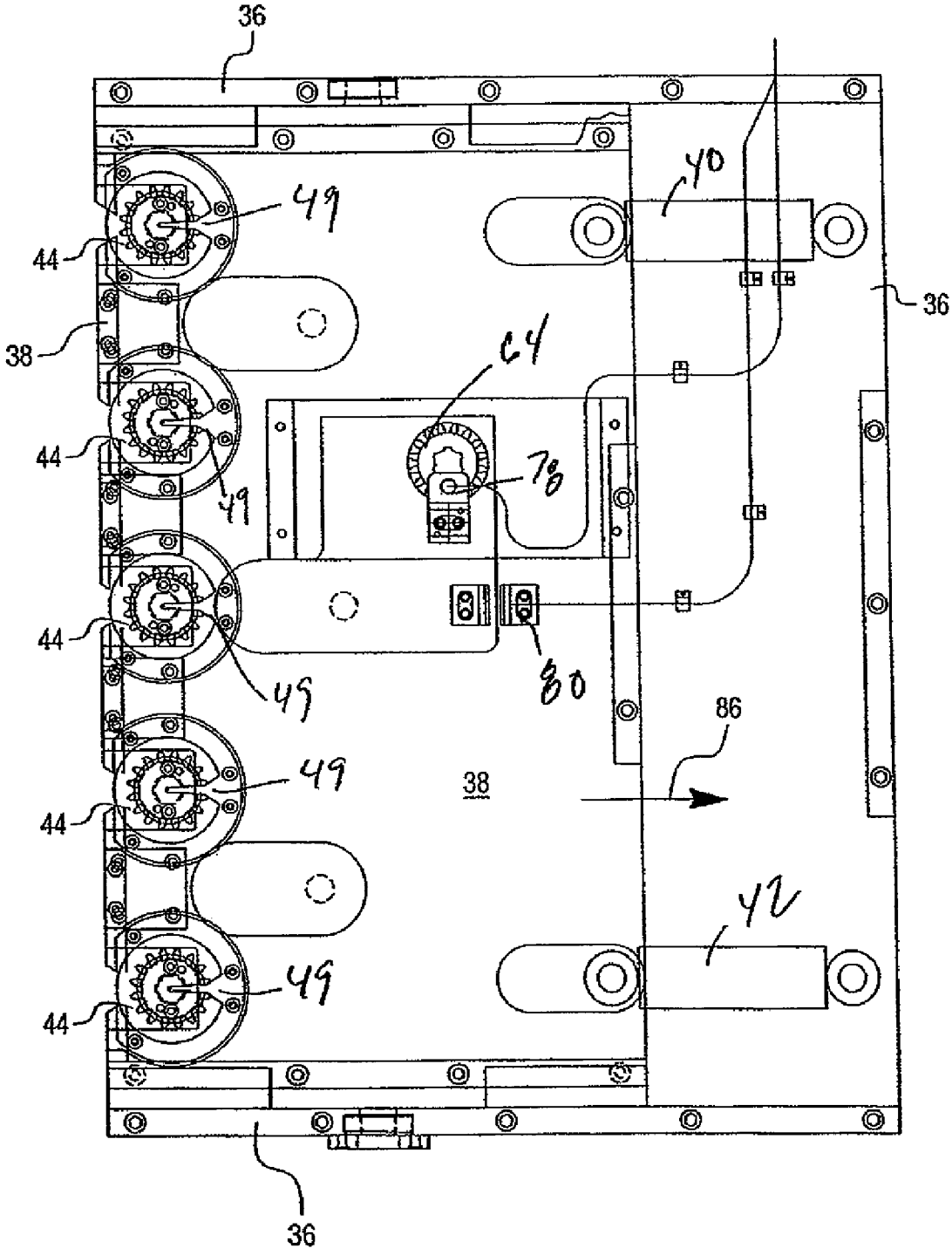

FIG. 10E shows the twister assembly 38 in the wire cutting position. As the twister assembly 38 moves in the direction of the arrow 86 from the locked position to the cutting position, the twisted sections 33 are engaged and cut by the cutting assembly 50, as shown in FIG. 8. The drives 40, 42 have sufficient power to cause mechanical cutting of the twisted sections 33 by the hardened cutting teeth 52.

Figure 10F:
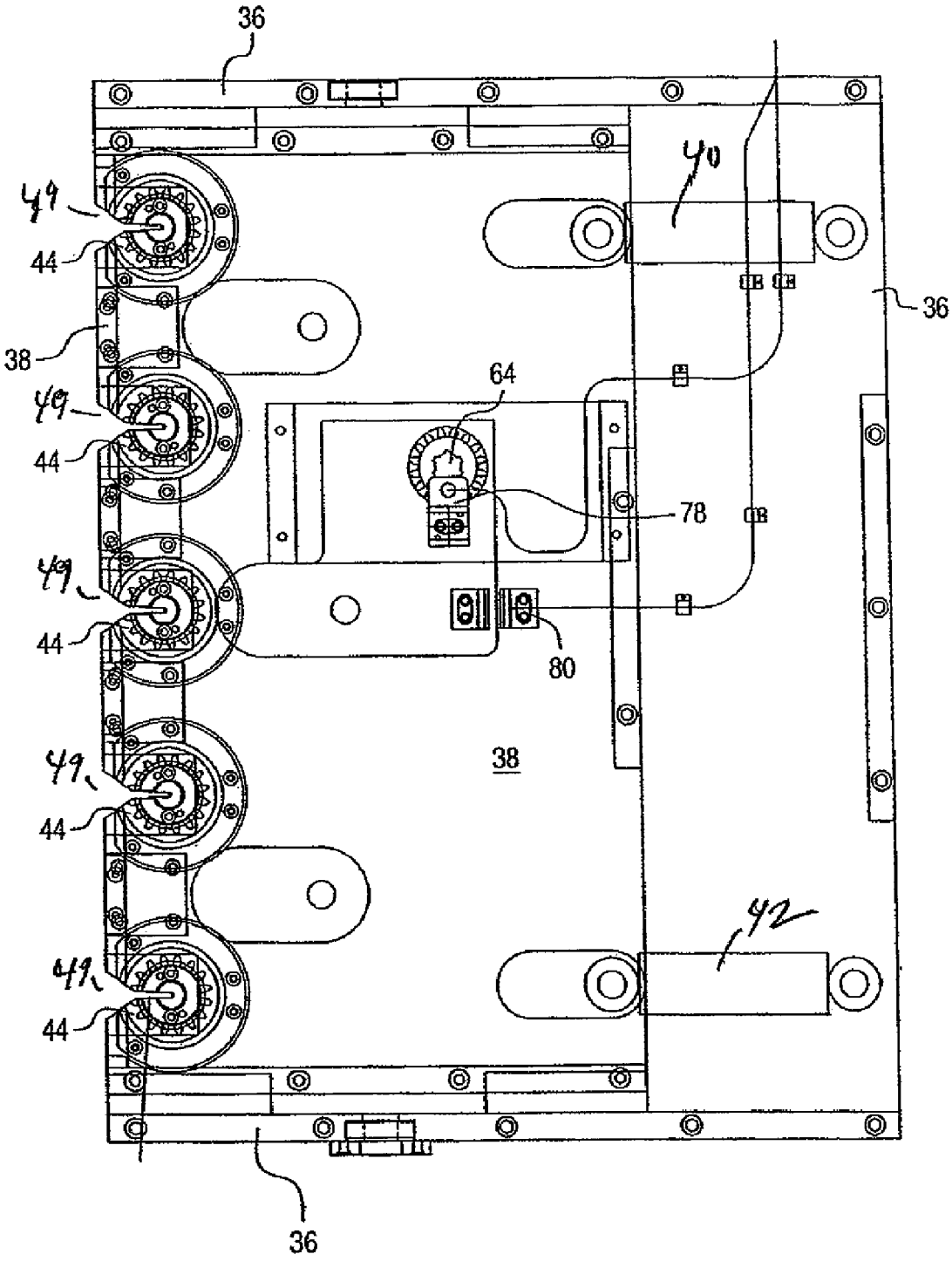

FIG. 10F shows the twister assembly 38 back in the home position after the twisted sections 33 have been cut. After the twisted sections 33 have been cut, the twister beads 44 rotate so that the funnel-shaped portions 49 of the twister heads 44 are facing outwardly. The twister assembly 38 may then move again into the extended position and repeat the cycle described above.

In operation, as described above, after the baling wire manipulation needles 26 pull respective first 30 and second 32 wire strands parallel to each other and adjacent to the binding unit 24, the twister assembly 38 moves into the extended position so that each of the twister heads 44 engage their respective first 30 and second 32 strands of baling wire (See FIGS. 3C and 10B). The twister assembly 38 then twists the wire strands 30, 32 to form twisted sections of wire (See FIGS. 3D and 10C). After the wires 30, 32 have been twisted, the twister assembly 38 moves into the locked position so that the wires 30, 32 are firmly held by the twister assembly 38 (See FIG. 10D). The twister assembly 38 then retracts to the cutting position, so that the twisted sections 33 are cut by the cutting assembly 50 (See FIGS. 3E, 8 and 10E). After the twisted sections 33 are cut, a first portion 34 of the twisted sections 33 completes and secures the bale 28, and a second portion 35 of the twisted sections connects the two strands of baling wire that will form the loop for the next successive bale (See FIG. 3E).

Figure 13A:
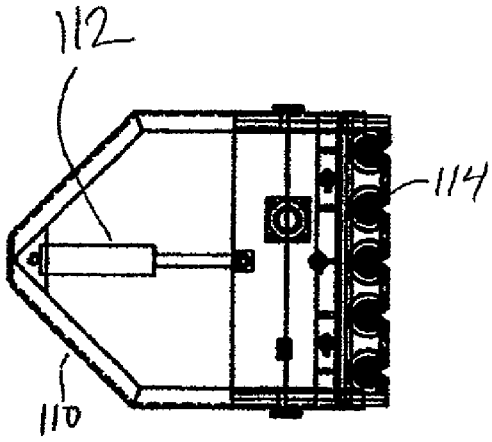
FIG. 13A is a fragmentary elevational view showing the alternative embodiment of the twister assembly in a fully extended position.
Figure 13B:
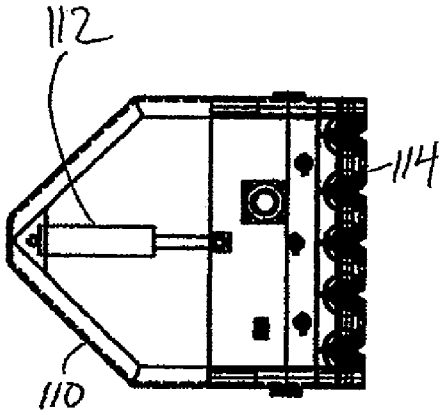
FIG. 13B is a fragmentary elevational view showing the alternative embodiment of the twister assembly in a cutting position.
Figure 13C:
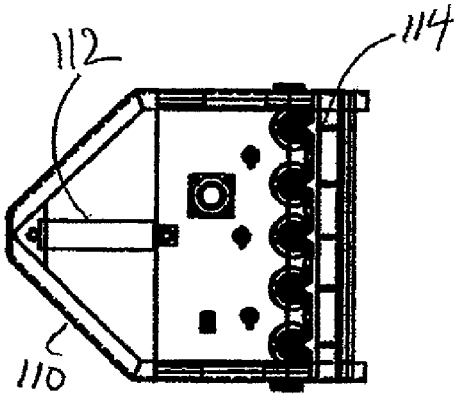
FIG. 13C is a fragmentary elevational view showing the alternative embodiment of the twister assembly in a maintenance position

With reference to FIGS. 12 and 13A-13C, an alternative embodiment of a baling apparatus includes a similar structure to the baling apparatus described above. However, with reference to FIG. 12, the slide housing 110 is trapezoidal in shape, although other shapes are feasible. In addition, instead of two drives 40, 42 as shown in FIGS. 10A-10F, a single drive 112 (as shown in FIGS. 13A-13C) is used to extend and retract the twister assembly. The single drive 112 performs the same function as the drives 40, 42, and the baling method is performed in the same manner as described in connection with FIGS. 10A-10F.

From the foregoing description it is clear that the present invention provides an effective and efficient baling machine. Although the current invention has been described as an apparatus for baling unconsolidated waste materials, the invention may also be used to bale agricultural materials. Additional applications should also be considered within the scope of the invention.

Further, it is understood that while various preferred designs have been used to describe this invention, the invention is not limited to the illustrated and described features. Modifications, usages and/or adaptations following the general principles disclosed herein are included in the present invention, including such departures that come within known or customary practice in the art to which this invention pertains. The present invention is intended to encompass all such departures having the central features set forth above, without departing from the scope and spirit of the invention, and which fall within the scope of the appended claims.

The invention claimed is:

1. A method of tying wire ties about a bale of material, comprising the steps of:

providing a bale of material at least partially enclosed by at least one loop of wire said loop being formed by a strand of wire having first and second integral lengths;

providing at least one elongated member having a plate and a pulley located thereon, the plate having an upward slant forming a tip portion and a back portion and the pulley is located adjacent to said back portion;

bringing the first and second integral lengths of wire into engagement with at least a first twister head located in a twister assembly by extending the elongated member to contact the first and second integral lengths of wire so that the wire will pass up and over the plate and pulley, then retracting the elongated member so that the wire contacts the pulley and is brought into engagement with the twister head;

extending the twister assembly outwardly from within a slide housing to further facilitate the engagement of the twister head and the length of wire;

rotating each twister head to twist the wire together and thereby creating a twisted section of wire wherein the slide housing pivots about an axis as the wire is twisted; and subsequently cutting the twisted section of wire with a cutting assembly.

2. The method of claim 1 wherein five twister heads engage corresponding lengths of wire.

3. The method of claim 1 wherein the cutting assembly is integrated with the slide housing and has a cutting tooth associated with each twister head.

4. The method of claim 3 wherein during said cutting step the twister assembly is retracted into the slide housing and the cutting tooth shears the twisted section of wire.

5. The method of claim 4 wherein during said cutting step the twisted section of wire is cut into a first portion tying a bale and a second portion forming a portion of a loop of baling wire.

6. The method of claim 1 wherein during said rotating step the twister head is driven by three interlocking gears.

7. The method of claim 1, wherein the twister assembly comprises a primary gear and a pair of secondary gears.

8. The method of claim 7, wherein the primary gear is driven by a drive shaft connected to a hydraulic motor.

9. The method of claim 1, wherein during said cuffing step the twister assembly is retracted into the slide housing and the cutting tooth shears the twisted section of wire.

10. The method of claim 9, wherein the steps are controlled by a control unit.

11. The method of claim 10, wherein the control unit comprises a programmable logic controller.

12. The method of claim 1, wherein the steps are controlled by a control unit.

13. The method of claim 12, wherein the control unit comprises a programmable logic controller.

* * * * *